United States Patent [19]

Sherwood

[11] 3,944,819

[45] Mar. 16, 1976

[54] PRODUCE GRADER

[75] Inventor: John R. Sherwood, Arlington, Va.

[73] Assignee: AMF Incorporated, White Plains, N.Y.

[22] Filed: Feb. 26, 1975

[21] Appl. No.: 553,362

[52] U.S. Cl. ..... 250/226; 209/111.6; 250/214 R; 330/10; 356/178; 356/195

[51] Int. Cl.[2] ..... B07C 5/342

[58] Field of Search ..... 250/226, 214 AG, 214 R; 356/173, 178, 195; 330/59, 10; 209/111.6

[56] References Cited

UNITED STATES PATENTS

| | | | |
|---|---|---|---|
| 3,060,790 | 10/1962 | Ward | 250/226 X |
| 3,173,017 | 3/1965 | Thayer | 250/226 |
| 3,691,470 | 9/1972 | Naylor | 330/10 X |
| 3,735,274 | 5/1973 | Nelson | 330/10 X |
| 3,795,811 | 3/1974 | Weir | 250/226 X |

*Primary Examiner*—Archie R. Borchelt
*Assistant Examiner*—E. R. La Roche
*Attorney, Agent, or Firm*—George W. Price; John H. Gallagher

[57] ABSTRACT

A produce grader that includes first and second signal paths for producing first and second signals corresponding to respective detected characteristics of an article of produce being graded. Each signal path includes chopper means for converting d.c. signals to a.c. signals, a.c. amplifier means, and means including synchronous detector means for reconverting amplified a.c. signals to d.c. signals. The reconverted signals are compared and/or evaluated to establish a basis for grading. Means are provided for adjusting the duty cycle of the gating signal controlling at least one synchronous detector thereby adjusting the gain of the corresponding signal path and adjusting the calibration of the grader.

6 Claims, 6 Drawing Figures

FIG. 4
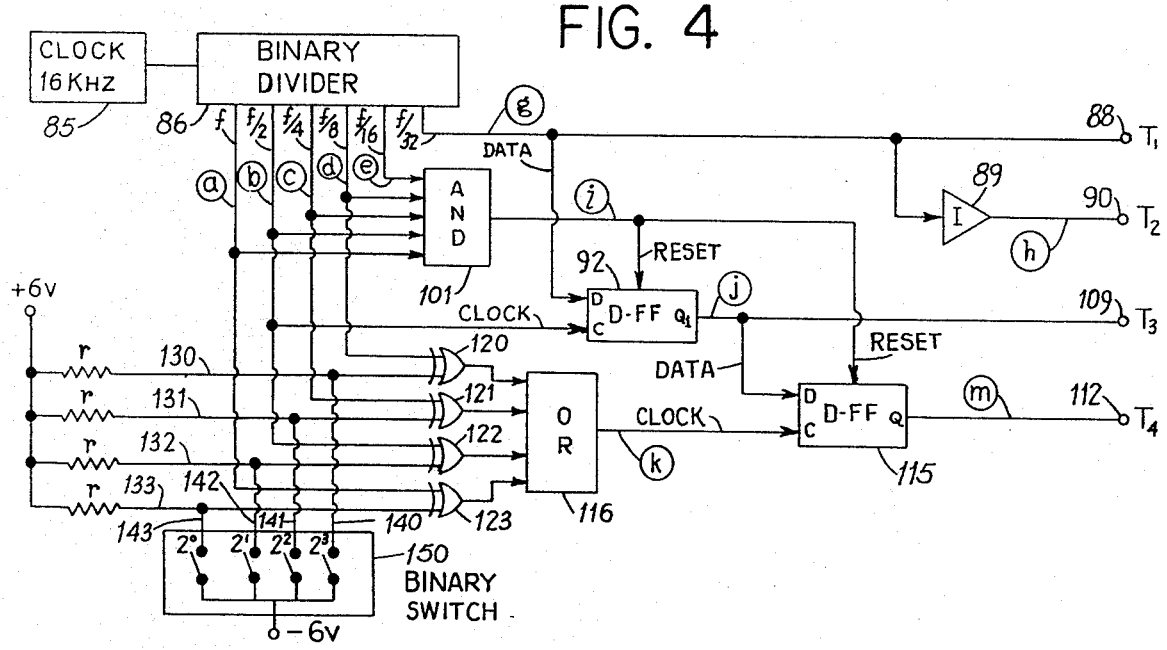
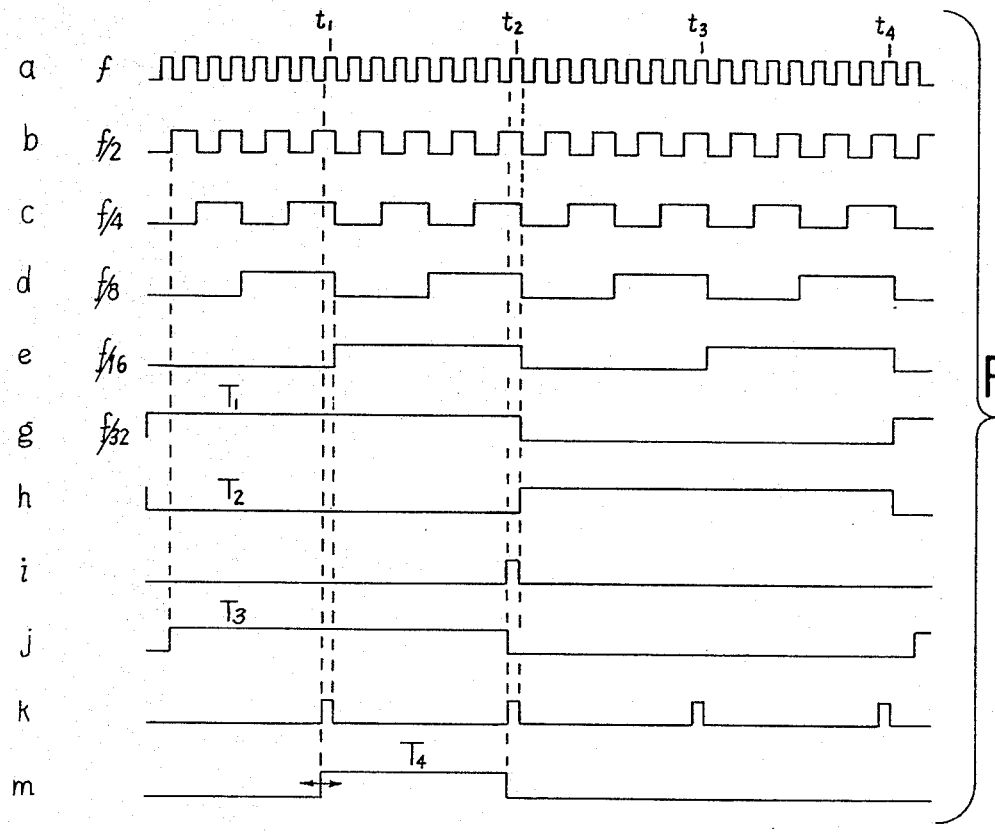
FIG. 5

PRODUCE GRADER

BACKGROUND OF THE INVENTION

In automatic fruit and vegetable graders the articles of produce commonly are graded, or sorted, according to their colors. The detection of colors usually is done by optical filters and electrooptic means, and the decision as to grading or sorting is based on an electronic evaluation of two or more signals which correspond to different spectra of light reflected from an article being graded.

Many photodetectors desirable for use in produce graders are semiconductor devices that operate with d.c. voltages. As is known, d.c. circuits, particularly high gain d.c. amplifiers which usually are required for use with semiconductor photodetectors, are relatively sensitive in their operation to changes in biasing voltages and to changes in temperature. Consequently, operating stability and calibration are difficult to maintain in produce graders employing d.c. active circuitry such as amplifiers in the low signal level portions of the apparatus. This difficulty is compounded in produce graders that employ multiple electrooptic inspection heads and multiple inspection signal channels to grade respective parallel lines or rows of produce moving on a conveyor belt. In apparatus of this type the calibration of all signal channels should be identical, and if any change of calibration is to be made, i.e., a change of ratio between different color signals in a channel, the change in all channels must be identical. This has been difficult to achieve in automatic produce graders, and much time and effort often is required to achieve and maintain the desired calibration condition for the apparatus.

SUMMARY OF THE PRESENT INVENTION

In this invention means are provided for quickly and reliably calibrating produce grading apparatus employing a plurality of inspection heads and a corresponding plurality of inspection signal channels. In the respective channels of the apparatus, the low voltage d.c. color signals at the outputs of the photodetectors are converted to a.c. signals by electronic switching means commonly called choppers. These a.c. signals then are amplified to desired signal levels by stable a.c. amplifiers. The amplified a.c. signals are passed through synchronous detectors and then are integrated or smoothed to reconvert them to d.c. levels. The reconverted d.c. signals in each inspection channel then are compared or otherwise evaluated in accordance with a selected calibration standard in order to reach a decision for grading the article being inspected.

In accordance with one feature of this invention, inexpensive electronic switching circuitry is employed for the choppers and for the synchronous detectors, and by means of selective timing in the gating of the synchronous detector switching means, transient spikes are eliminated from the chopped signals and substantially no degradation of the color signals is experienced. Further, by providing means for adjusting the duration of the gating signals that control the synchronous detectors, the ratio of compared color signals, i.e. calibration, in an inspection channel may be accurately controlled. In multiple channel produce grading apparatus, the calibration of all channels is accomplished simultaneously and identically by employing the same gating waveforms to control the operations of the choppers and synchronous detectors in all channels.

BRIEF DESCRIPTION OF THE DRAWINGS

FIG. 4 is a simplified block diagram of timing means for generating gating waveforms used in the circuitry of FIGS. 2*a* and 2*b;* and FIGS. 5 and 6 are simplified and illustrative waveforms used in describing the operation of the timing means of FIG. 4.

DETAILED DESCRIPTION OF PREFERRED EMBODIMENT

The invention will be described for use in a produce grader or sorter of the type that grades tomatoes by color. It is to be understood that other articles of fruits or vegetables, and tobacco leaves, for example, could be sorted in accordance with their colors by selecting proper light sources, filters and optical detectors, as required. Furthermore, the features of this invention, in their broader aspects, are not limited to electrooptic inspection techniques but may be extended to other types of inspection techniques.

Figures 1, 2B:
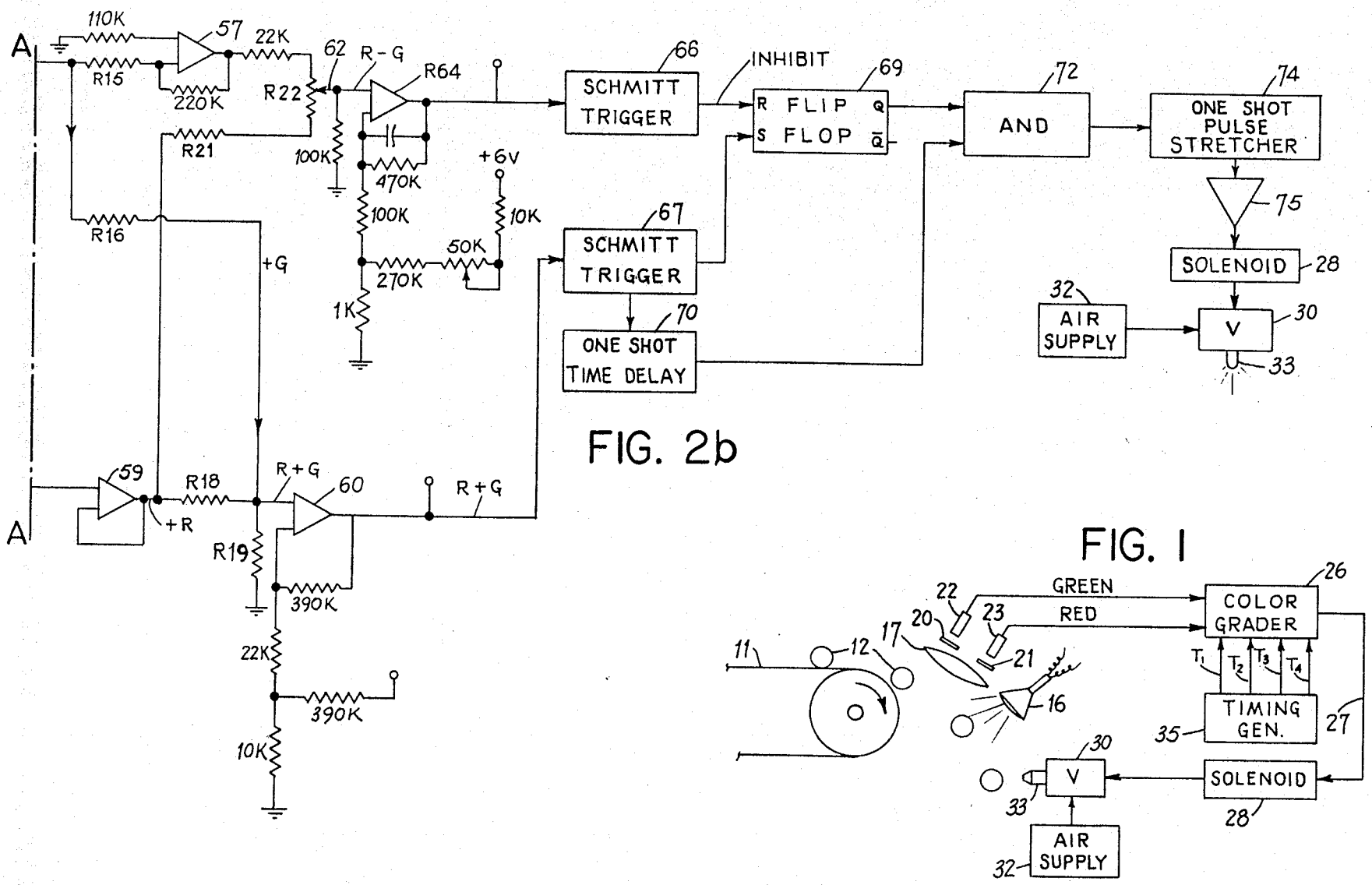
FIG. 1 is a simplified block diagram illustrating a type of produce grader in which the present invention may be used.
FIGS. 2*a* and 2*b*, taken together, are a detailed schematic diagram, partially in block form, illustrating one electronic inspection channel of a produce grader of this invention.

Referring in detail to the drawings, FIG. 1 illustrates in simplified form a produce grader system in which the present invention may be employed. A continuous conveyor belt 11 carries the articles of produce such as tomatoes 12 in single file to the end of the conveyor where the articles are discharged in a free fall path. A light source 16 illuminates the discharged tomatoes and the light reflected therefrom is passed through a lens system 17 which directs the reflected light onto both a green optical filter 20 and a red optical filter 21. The green light is detected by photodetector means 22 and the electrical signal corresponding to the incident green light is passed as one input to color grader 26. The red reflected light is detected by photodetector 23 and the electrical signal corresponding thereto is coupled as the second input to color grader 26. Color grader 26 is constructed and arranged to compare and otherwise evaluate the green and red color signals to determine when an article of produce 12 being inspected falls outside of a predetermined color range. Upon determining that the tomato 12 is too green, for example, an output signal is produced on line 27 to energize a solenoid 28 which controls an air valve 30. Upon the opening of air valve 30 a blast of air is passed from air supply 32 and is discharged through nozzle 33 to deflect a green tomato from its free fall path, thereby sorting it from the acceptable red tomatoes.

A timing waveform generator 35 couples respective timing waveforms $T_1$, $T_2$, $T_3$ and $T_4$ to color grader 26. As will be explained below, these timing waveforms control circuitry within color grader 26 to produce the novel and improved operation of the color grader.

It is to be understood that in practice conveyor belt 11 may have as many as eight or more aligned successions of produce moving in parallel along the conveyor.

For simplicity, this discussion is limited to a single succession of produce moving along conveyor 11 and to a single color grader electronic signal channel. In practice each aligned succession of articles will have associated with it an electrooptic inspection head, a color grader electronic channel, and an article ejection means.

Figure 2A:
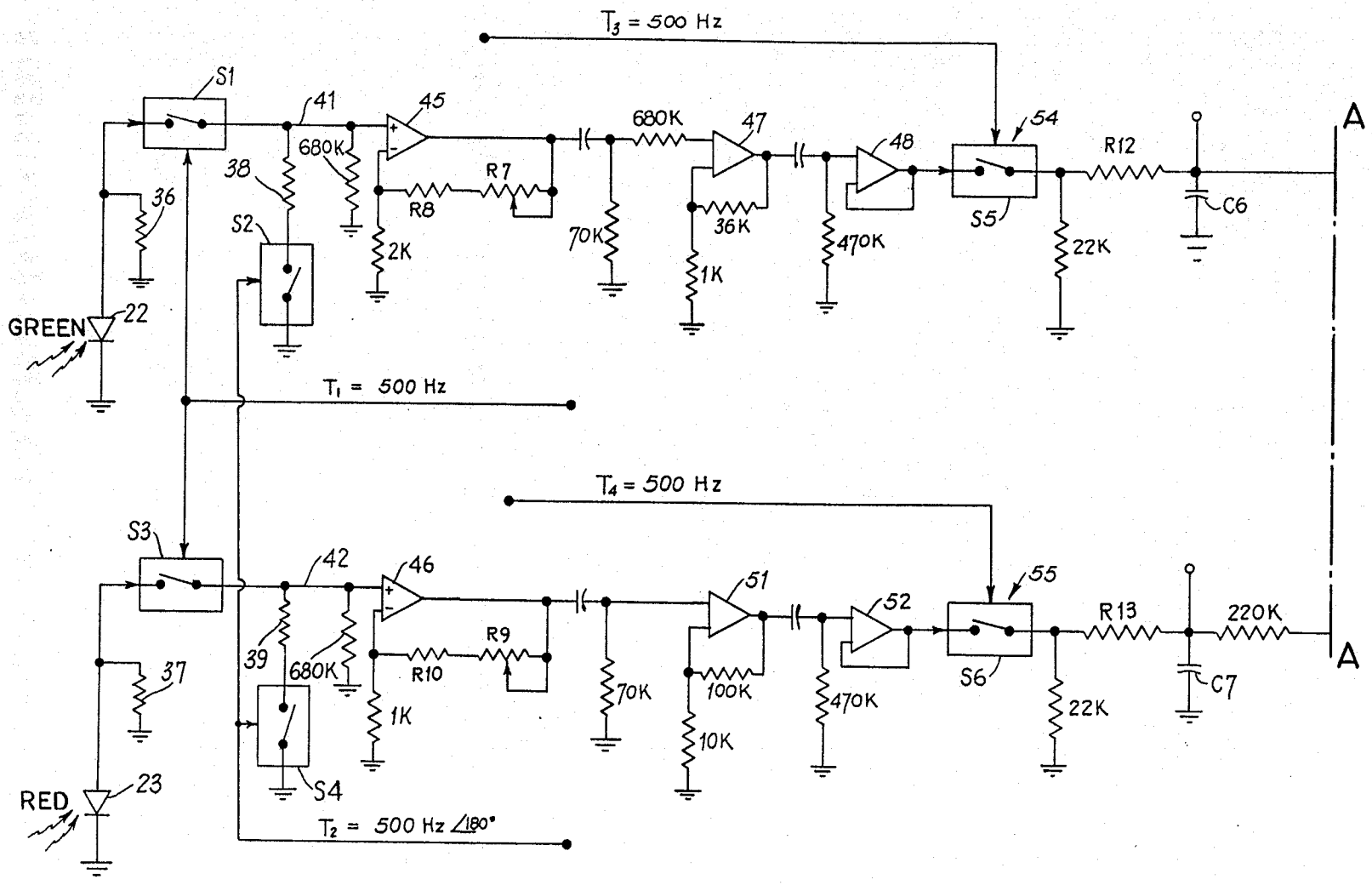

Referring to the detailed circuit diagram illustrated in FIGS. 2*a* and 2*b*, one channel of the color grader of this invention comprises the photodetectors 22 and 23 for detecting, respectively, the green and red light reflected from a tomato at the inspection position in its free fall path. In practice, photodetectors 22 and 23 may be silicon photovoltaic light sensors operated in the short circuit mode. A suitable type of photodetector is a photodiode FPT-5022 sold by Fairchild Semiconductor. Photodiodes 22 and 23 operate into their respective load resistors 36 and 37, both of which are connected to ground.

The voltage appearing across load resistor 36 is coupled to an electronic chopper which is comprised of gated switches $S_1$ and $S_2$. Switch $S_1$ is series connected in the green signal path and is controlled in its open - close switching operation by a gating waveform $T_1$ which is a 500 Hertz square wave. Switch $S_2$ is in shunt with the green signal path and when closed provides a connection to ground through resistor 38. Switch $S_2$ is controlled in its open - close switching operation by a gating waveform $T_2$ which also is a 500 Hertz square wave but which is 180° phase displaced with respect to gating waveform $T_1$. Each switch closes in response to a positive half cycle of its respective gating waveform. Switches $S_1$ and $S_2$ thus operate alternately so that when series switch $S_1$ is closed the shunting switch $S_2$ is open, and vice versa. The chopper output signal on line 41 is a 500 Hertz square wave whose positive half cycles have a voltage magnitude substantially equal to the low level d.c. green signal from photodiode 22 and whose negative half cycles are at ground potential.

Although series and shunting switches are illustrated for the choppers in FIG. 2*a*, it will be understood by those skilled in the art that only series or shunt switches are required to produce the chopping action. In such case, only the one gating signal $T_1$ would be required.

In a similar manner the red signal voltage across load resistor 37 is chopped by switches $S_3$ and $S_4$ under control of timing waveforms $T_1$ and $T_2$ to produce a 500 Hertz red color signal on line 42.

The green a.c. signal on line 41 is coupled to a.c. amplifier 45 and the red a.c. signal on line 42 is coupled to a.c. amplifier 46. Both of these amplifiers are high gain amplifiers, but because of relatively high feedback voltages coupled back to their inputs through resistors $R_7$, $R_8$ and $R_9$, $R_{10}$, respectively, the amplifiers actually operate with a relatively low gain on the order of 10 to 20. Thus, amplifiers 45 and 46 are highly stable in their operation.

The green a.c. signal from the output of amplifier 45 is successively capacitively coupled to operational amplifier 47 and buffer amplifier 48, both of which are low gain, highly stable, a.c. amplifiers. In a similar manner the red a.c. signal from the output of amplifier 46 is successively capacitively coupled to the operational amplifier 51 and buffer amplifier 52, both of which are low gain, highly stable, a.c. amplifiers.

The a.c. output signals from amplifiers 48 and 52 in the green and red color signal paths are respectively coupled to synchronous detectors 54 and 55. The synchronous detectors are comprised of electronic switches $S_5$ and $S_6$ whose operations are controlled by respective gating waveforms $T_3$ and $T_4$. Waveforms $T_3$ and $T_4$ are 500 cycle square waves that occur in synchronism with waveform $T_1$ which controls series chopper switches $S_1$ and $S_3$. Switches $S_5$ and $S_6$ close during the positive half cycles of their respective gating waveforms $T_3$ and $T_4$. As will be explained in detail below, the duty cycles, or time durations, of the gating pulses of waveforms $T_3$ and $T_4$ are shorter than the duty cycle of waveform $T_1$. Further, the duty cycle of waveform $T_4$ is adjustable to provide adjustable gain control for the red color signal path.

In FIG. 2 the chopper switches $S_1$–$S_4$ and the synchronous detector switches $S_5$, $S_6$ are illustrated as simple switches. In practice they are electronic switches that are manufactured as integrated circuits. For example, the type CD4016A COS/MOS quad bilateral switch, available from Radio Corporation of America (RCA Corp.), may be used. These integrated circuit devices contain four switches on a chip. One such device may be employed for chopper switches $S_1$–$S_4$ and another one may be used for synchronous detector switches $S_5$ and $S_6$. Actually, since four switches are available on a chip, switches $S_5$ and $S_6$ each may be comprised of two switches operated in parallel.

The a.c. output of synchronous detector 54 in the green color signal path is integrated or smoothed to a d.c. level by the combination of series resistor $R_{12}$ and shunt capacitor $C_6$. The output of synchronous detector 55 in the red color signal path is integrated or smoothed to a d.c. level by series resistor $R_{13}$ and shunt capacitor $C_7$.

Referring to FIG. 2*b*, the green d.c. signal which now is at a relatively high level is coupled through resistor $R_{15}$ to the input of inverting amplifier 57, a low gain, low drift, d.c. operational amplifier. The green d.c. signal also is cross coupled through resistor $R_{16}$ to the junction of resistors $R_{18}$ and $R_{19}$ where it is added to the red d.c. signal after the latter has been amplified in buffer amplifier 59, which also is a low gain, low drift, d.c. operational amplifier.

The positive polarity red d.c. signal from buffer amplifier 59 is cross coupled through resistor $R_{21}$ to one input of potentiometer $R_{22}$. The other input on the opposite end of potentiometer $R_{22}$ is the negative polarity green signal from inverting amplifier 57. Slider contact 62 of potentiometer $R_{22}$ thus picks off a signal R-G which is the difference in magnitude between the red and green d.c. signals.

The positive green signal and the positive red signal that are combined at the junction of resistors $R_{18}$ and $R_{19}$ are amplified in low gain operational amplifier 60. The R+G signal at the output of amplifier 60 is used in the system to determine that an object, any object, is at the inspection position and is being viewed by photodetectors 22 and 23. This R+G signal will be utilized in logic circuitry to be described as a basis for determining that some object is being inspected and should be graded. The R–G signal on sliding contact 62 is evaluated in the logic circuitry to determine whether or not the inspected object is to be rejected or is to be passed on with the acceptable red tomatoes.

During the initial calibration of the system a white (or other suitable color) background temporarily is placed in front of photodiodes 22 and 23. Slider contact 62 of potentiometer $R_{22}$ then is adjusted so that its output is zero. Subsequently, in operation, a positive output signal on sliding contact 62 will indicate that the red signal input to potentiometer $R_{22}$ is greater than the green signal input thereto and that the tomato being inspected is an acceptable red tomato. A negative output signal on sliding contact 62 indicates that the negative green input signal to potentiometer $R_{22}$ is greater than the red input and that the tomato being inspected is unacceptably green.

The output signal R−G of potentiometer $R_{22}$ is amplified in operational amplifier 64 and is coupled to Schmitt trigger circuit 66. The output signal R+G of amplifier 60 is coupled to Schmitt trigger circuit 67. In each of the trigger circuits a positive input signal will produce a positive output signal therefrom and a negative or zero input signal will produce no output signal therefrom. The outputs of trigger circuits 66 and 67 are coupled, respectively, to the reset and set inputs of flip flop circuit 69. The output of R+G trigger circuit 67 also is coupled to the input of one shot delay multivibrator 70. The time delay provided by one shot delay multivibrator 70 is equal to the free fall time of an article of produce falling from the inspection position where it is viewed by photodetectors 22 and 23 to a position in front of air nozzle 33 where it may be deflected from the free fall path.

The output of time delay multivibrator 70 and the Q output of flip flop 69 are coupled as inputs to AND gate 72. An output signal from AND gate 72 triggers a one shot pulse stretcher multivibrator 74 whose output is amplified in solenoid driver 75. The stretched and amplified signal energizes solenoid 28 which operates air valve 30 to produce a blast of air from nozzle 33, as previously described.

The triggering and logic circuits just described in connection with FIG. 2b operate in response to R+G signals and R−G signals in the following manner. The presence of an R+G signal at the output of amplfier 60 indicates that some object or article is at the inspection position and should be graded. Schmitt trigger circuit 67 produces a trigger pulse in response to an R+G signal and this pulse will attempt to set flip flop 69 in its second stable state to produce an output signal on its Q output lead. If the article being viewed at the inspection position is an acceptable red tomato a positive R−G signal will trigger Schmitt trigger circuit 66 whose output is coupled to the reset input of flip flop 69. Therefore, the presence of a positive R−G signal (red tomato) will prevent flip flop 69 from changing states and no output signal is produced at its Q output. Consequently, one input signal to AND gate 72 is absent and nothing passes therethrough. In this instance solenoid 28 is not energized and no air blast is discharged from nozzle 33. The red tomato therefore continues on its free fall path from the discharge end of conveyor 11, FIG. 1.

If the article being viewed by photodetectors 22 and 23 is a green tomato, a rock, or a clod of dirt, for example, the R−G signal on sliding contact 62 will be zero or a negative signal. This type of signal will not trigger Schmitt trigger 66 and no reset signal will be coupled to flip flop 69. Flip flop 69 therefore transfers to its set condition and the output signal on its Q output terminal is coupled to AND gate 72. The other input to AND gate 72 is the delayed R+G signal which will be present since an object is at the inspection position. A signal therefore passes AND gate 72 and triggers one shot pulse stretcher 74. The stretched pulse from one shot multivibrator 74 is amplified and energizes solenoid 28 which opens air valve 30 to permit a blast of air from air supply 32 to be discharged from nozzle 33. As a result, a green tomato, a rock, or a clod or dirt is ejected from the free fall path and is sorted from the acceptable red tomatoes.

Figure 3:
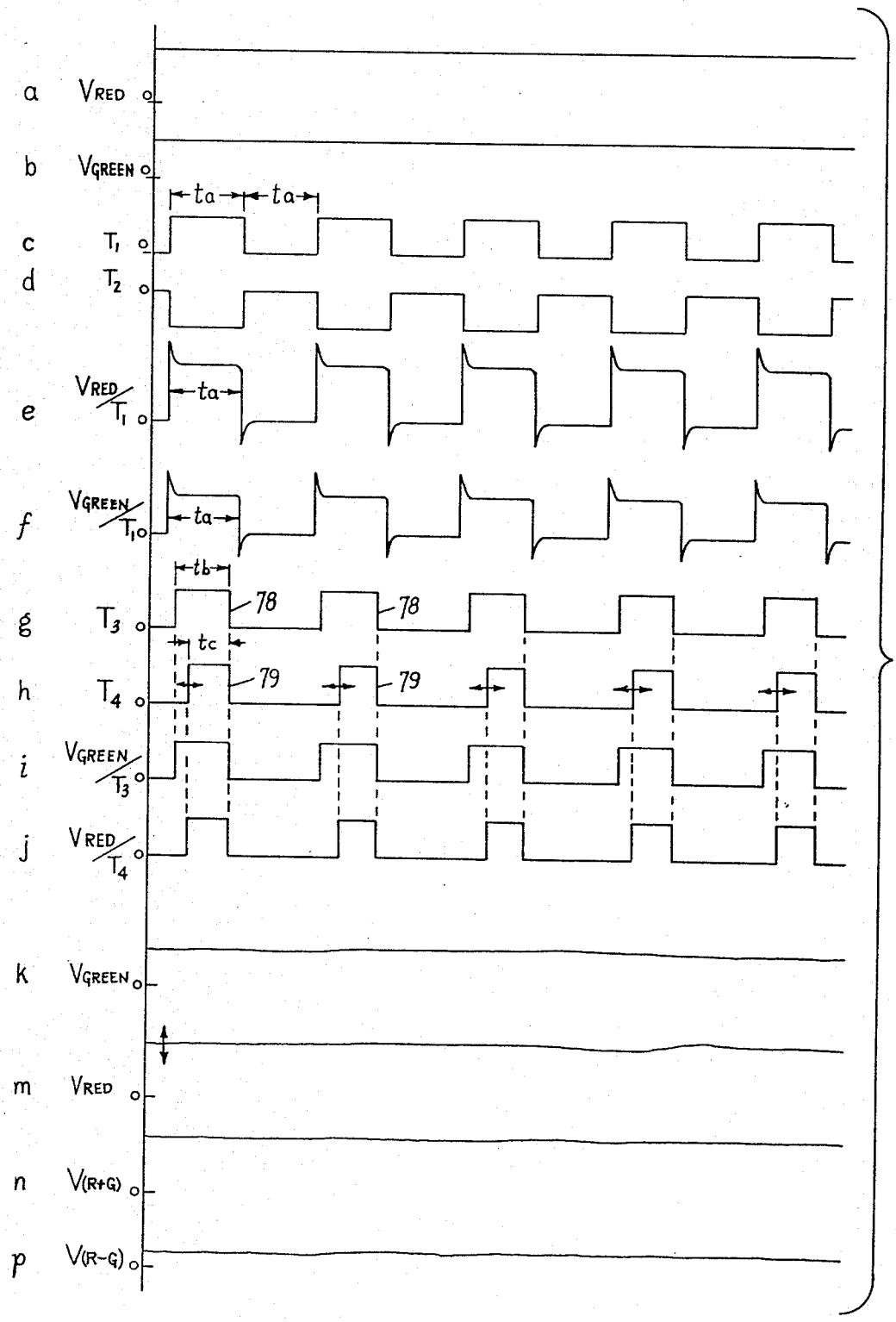
FIG. 3 is a series of simplified and illustrative waveforms used in explaining the operation of the electronic inspection channel of FIGS. 2*a* and 2*b;*

Attention now will be directed more particularly to the novel features and operation of chopper switches $S_1$–$S_4$ and synchronous detector switches $S_5$ and $S_6$, together with the gating waveforms $T_1$–$T_4$ associated therewith. In discussing these features, reference first will be made to the waveforms illustrated in FIG. 3. For purposes of discussion it will be assumed that an acceptable red tomato is being viewed by photodetectors 22 and 23. In accordance with the conditions assumed in this example, the d.c. output of red photodetector 23 is illustrated in FIG. 3*a* and the d.c. output of green photodetector is illustrated in FIG. 3*b*. It will be noted that the red signal, FIG. 3*a*, is assumed to be greater than the green signal, FIG. 3*b*. In practice, both signals are at low levels.

Waveform $T_1$ which controls series chopper switches $S_1$ and $S_3$ is illustrated in FIG. 3*c* as a symmetrical 500 Hertz square wave having a duty cycle ta. Waveform $T_2$ which controls shunt chopper switches $S_2$ and $S_4$ is illustrated in FIG. 3d. Waveform $T_2$ is 180° phase displaced with respect to waveform $T_1$, but otherwise the two waveforms are identical.

As a result of the alternate operation of series and shunt chopper switches in the signal paths the chopped red signal output on line 42 is a generally square waveform illustrated in FIG. 3*e*. The magnitude of the level portions of the positive half cycles of waveforms of FIG. 3*e* correspond to the relatively low magnitude of the red d.c. signal of FIG. 3*a*. Similarly, the positive half cycles of the chopped green waveform of FIG 3*f* have magnitudes corresponding to the relatively low magnitude of the green d.c. signal of FIG. 3*b*. Because the series chopper switches $S_1$ and $S_3$ in the green and red paths are controlled by waveform $T_1$, FIG. 3*c*, and the shunt switches $S_2$ and $S_4$ both are controlled by waveform $T_2$, FIG. 3*d*, the chopped red and green signals, FIGS. 3*e* and 3*f* are in phase with each other.

It will be noted that the leading and trailing edges of each half cycle of the chopped red and green waveforms of FIGS. 3*e* and 3*f* have rather large spikes. These spikes are caused by inherent leakage capacitance in the semiconductor switching devices of switches $S_1$–$S_4$. This capacitance acts as a differentiator to produce the spikes whose magnitudes are large relative to the green and red signals which are at low levels at this portion of the system.

After the chopped green and red signals are successively amplified in capacitively coupled a.c. amplifiers 45, 47, 48, and 46, 51, 52, respectively, the amplified signals are coupled to the inputs of switches $S_5$ and $S_6$ of synchronous detectors 54 and 55. Switch $S_5$ is controlled in its switching operation by non-symmetrical square waveform $T_3$, FIG. 3*g*, and switch $S_6$ is controlled in its switching operation by non-symmetrical square waveform $T_4$, FIG. 3*h*. It will be noted that the positive going gating pulses 78 of waveform $T_3$ have a shorter duty cycle, or time duration *tb*, than the duty cycle *ta* of the positive going pulses of the chopped green waveform, FIG. 3*f*, which is applied to the input of switch $S_5$. As a result of this time relationship, switch $S_5$ is closed only for the time duration *tb* during each positive going pulse of the chopped green input signal. Consequently, only the level mid portion of each positive pulse of the input signal is passed through the synchronous detector 54 and the objectionable spikes at the leading and trailing edges of waveform *3f* are not passed therethrough. The output signal of synchronous detector 54 is illustrated in FIG. *3i*.

The operation of switch $S_6$ of synchronous detector 55 is similar to that just described. It will be seen in FIG. *3h* that the positive going gating pulses 79 of gating waveform $T_4$ have a shorter time duration tc than the positive going pulses of the chopped red input signal of FIG. *3e*. Consequently, only the level mid portion of each positive pulse of the chopped red input signal is passed through synchronous detector 55 and the objectionable spikes are not passed therethrough. The output signal of the synchronous detector is illustrated in FIG. *3j*.

Because the signals that are coupled to the synchronous detectors have been amplified in the a.c. amplifiers, their magnitudes are relatively large and any transients produced by switches $S_5$ and $S_6$ are relatively minor and unobjectionable. The output signals of synchronous detectors 54 and 55, FIGS. *3i* and *3j* are integrated or smoothed in the respective integrators comprised of the resistor and capacitor combinations $R_{12}$, $C_6$ and $R_{13}$, $C_7$. The resultant green and red d.c. signals are illustrated in the waveforms of FIGS. *3k* and *3m*. Because the objectionable spikes have been eliminated from the red and green a.c. signals, they do not affect the smoothed signals at the outputs of the respective integrators.

The smoothed green signal is cross coupled through resistor $R_{16}$ and is added with the smoothed red signal at the junction of resistors $R_{18}$ and $R_{19}$ to produce the R+G signal of FIG. *3n*. The smoothed green signal is inverted in amplifier 57 and is subtracted at potentiometer $R_{22}$ from the smoothed red signal which is cross coupled through resistor $R_{21}$. This R−G signal is illustrated in FIG. *3p*.

As explained above, the R−G signal on the sliding contact 62 of potentiometer $R_{22}$ is the signal which is the basis on which the logic circuitry makes a decision whether to pass or eject a detected article. Consequently, the inspection channel may be calibrated by adjusting the magnitude of one or both the input signals to potentiometer $R_{22}$. In accordance with the illustrated embodiment of this invention, calibration is accomplished by adjusting the magnitude of the smoothed red signal input to potentiometer $R_{22}$. This is done by adjusting the duty cycle of gating waveform $T_4$ which controls switch $S_6$ of synchronous detector 55. As seen in FIG. *3h*, the leading edges of the positive going gating pulses 79 of waveform $T_4$ are adjustable in time of occurrence. By adjusting the leading edge of the gating pulses of waveform $T_4$, more or less of the level portion of the chopped red waveform of FIG. *3e* is gated through synchronous detector 55. This will correspondingly increase or decrease the magnitude of the integrated or smoothed signal at the output of integrator $R_{13}$, $C_7$. The means for adjusting the time of occurrence of the leading edges of the gating pulses 79 of waveform $T_4$ will be explained below.

The R+G signal, which indicates that some object is being viewed by photodetectors, is amplified in d.c. amplifier 60 and coupled to Schmitt trigger circuit 67. The R−G signal, which indicates the color of the viewed object, is coupled to Schmitt trigger circuit 66. The subsequent logic circuitry functions as described above to determine whether or not a blast of air should be expelled from nozzle 33 to eject the article being viewed.

The means for generating gating waveforms $T_1$–$T_4$ which control operation of chopper switches $S_1$–$S_4$ and synchronous detector switches $S_5$ and $S_6$ will be described by referring to the simplified circuit diagram of FIG. 4 and the associated waveforms of FIG. 5. A clock pulse generator 85 produces timing pulse at a frequency of 16 KHz, for example. The output of clock pulse source 85 is coupled to the input of a binary divider chain 86 which produces the output waveforms of FIGS. *5a*, *5b*, *5c*, *5d*, *5e* and *5g*. These waveforms range from the basic timing frequency *f*, FIG. *5a*, to the frequency *f*/32, FIG. *5g*. This latter waveform is coupled to terminal 88 and serves as gating waveform $T_1$ that controls the series chopper switches $S_1$ and $S_3$, FIG. *2a*. This same waveform is inverted in polarity by interter 89 and is available at terminal 90 as gating waveform $T_2$, FIG. *5h*, which controls the shunt chopper switches $S_2$ and $S_4$ of FIG. *2a*.

The waveform of FIG. *5g*, at the frequency *f*/32, also is coupled as the data input to flip flop 92. This device may be a D-type flip flop 4103 which is commonly available from a number of semiconductor device manufacturers. The clock input to flip flop 92 if the waveform of FIG. *5b* at the frequency *f*/2.

The reset input to flip flop 92 is generated as follows. Waveforms of FIGS. *5a*–*5e* at the respective frequencies *f*–*f*/16 are coupled as inputs to AND gate 101 which responds thereto to produce the output pulse of FIG. *5i*. It is seen that the duration of the reset pulse of FIG. *5i* is that of a pulse of the basic frequency *f*, FIG. *5a*.

D-type flip flop 92 operates as follows. In its reset condition the $Q_1$ output is at its lower level. With data and clock inputs present, the clock input will cause the output $Q_1$ to be set to a high or low level that corresponds to the level of the data input. A reset signal overrides all other inputs and resets the device to its first stable state in which $Q_1$ output is low.

The output of flip flop 92, FIG. *5j*, is available on terminal 109 and is the gating waveform $T_3$ that controls the operation of synchronous detector 54 in the green color signal path of FIG. 2. The manner in which waveform $T_3$ is produced may be seen by referring to FIG. 5. The data input to flip flop 92 is waveform FIG. *5g*, the gating waveform $T_1$ which is positive at the beginning of the time period represented in FIG. 5. The clock input to flip flop 92 is waveform FIG. *5b*, which is at its lower level at the beginning of the time period represented in FIG. 5. As soon as the first positive pulse of waveform FIG. *5b* occurs, flip flop 92 transfers to its second stable state and its output, FIG. *5j*, goes to its higher level. Flip flop 92 remains at its higher level until the occurrence of the reset pulse of FIG. *5i* at which time it returns to its first and lower level.

A comparison of the waveforms of FIGS. *5g* and *5j* shows that the positive going portion of gating waveform $T_3$ commences after the occurrence of the leading edge of gating waveform $T_1$ and that the trailing edge of gating waveform $T_3$ occurs before the trailing edge of the positive portion of gating waveform $T_1$. Thus the duty cycle of the positive gating pulse of waveform $T_3$ is shorter than that of the positive gating pulse of waveform $T_1$. This relationship permits synchronous detector 54, FIG. *2a*, to gate out the undesirable spikes at the leading and trailing edges of the chopped green signal, FIG. *3f*, so that the output of synchronous detector 54, FIG. 3*h*, is a clean waveform substantially devoid of transient spikes.

Gating waveform $T_4$ which controls synchronous detector 55 in the red color signal path of FIG. 2*a* appears on output terminal 112 of flip flop 115 in FIG. 4. Flip flop 115 is a D-type flip flop 4013 substantially identical to flip flop 92 described above. The data input to flip flop 115 is gating waveform $T_3$ of FIG. 5*j*. The clock input to flip flop 115 is a series of pulses from OR gate 116. The times of occurrence of these input clock pulses may be changed to make adjustable the leading edges, and thus the duty cycle, of the gating pulse of waveform $T_4$. This is accomplished as follows.

The four inputs to OR gate 116 are the respective outputs of EXCLUSIVE OR (EX OR) gates 120-123. Waveforms FIGS. 5*d*, 5*c*, 5*b* and 5*a* from binary divider 86 each constitute one input to a respective EX OR gate 120–123. A second input to each EX OR gate is one of the lines 130–133 each of which is coupled through a resistor *r* to a +6 volt source. Lines 130–133 are respectively shunted by one of the lines 140–143 which couple to a fixed contact of a binary switch 150. Switch 150 is a thumbwheel switch having four movable contacts parallel coupled to a −6 volt supply. The four individual switches are binary weighted from $2^0$ to $2^3$. Thumbwheel switch 150 has 16 different switching combinations of the individual binary weighted switches and as the thumbwheel switch is stepped through its switching positions the individual $2^0$ –$2^3$ switches close and open in accordance with binary counting to correspondingly connect the lines 140-143 to the −6 volt supply. A suitable binary thumbwheel switch is the type BB 239S manufactured by Interswitch Corp., Burlingame, California.

When binary weighted switch $2^3$ is open line 130 is at +6 volt and when switch $2^3$ is closed line 130 is at −6 volts. The voltage biases on the remainder of the lines 131, 132, and 133 vary in like manner as their respective binary weighted switches $2^2$, $2^1$, and $2^0$ are open and closed.

EX OR gate 120 operates in the following manner. When its input line 130 is high (switch $2^3$ open), its other input, waveform FIG. 5*d*, passes through the gate without inversion. When input line 130 is low (switch $2^3$ closed), its other input, waveform FIG. 5*d*, is inverted in passing through the EX OR gate 120. The other EX OR gates 121–123 operate similarly. Thus, depending on the settings of the binary weighted switches $2^0$ – $2^3$ of binary thumbwheel switch 150, inverted or noninverterd waveforms FIGS. 5*a*–5*d* are passed through EX OR gates 120–123 and are combined in OR gate 116.

One example of a specific setting of binary thumbwheel switch 150 will serve to illustrate the operation of the logic circuitry described immediately above. Assuming that all four binary weighted switches $2^0$ – $2^3$ are open, (binary 0), as illustrated in FIG. 4, all input signals of FIGS. 5*a–d* will pass through EX OR gates 120–123 without inversion. Referring to FIG. 5 it will be seen that only at times *t*1, *t*2, *t*3, and *t*4 are all of the waveforms of FIGS. 5*a*, *b*, *c*, and *d* at a positive polarity. Accordingly, only at these times will the positive output pulses of FIG. 5*k* be produced. It will be noted that these pulses have the short duration of the pulses of basic frequency *f*, FIG. 5*a*.

Waveform FIG. 5*k* is coupled as the clock input to flip flop 115, and with waveform FIG. 5*j* ($T_3$) as the other input the first pulse of FIG. 5*k* produces the leading edge of the output signal of flip flop 115, see FIG. 5*m*. Flip flop 115 remains in its second stable state until the occurrence of the reset pulse of FIG. 5*i* at which time the positive pulse of waveform FIG. 5*m* terminates. This waveform is the gating waveform $T_4$ which controls switch $S_6$ in synchronous detector 55, FIG. 2.

A similar comparison of the waveforms of FIGS. 5*a–d*, whether inverted or noninverted, depending on the conditions of binary weighted switches $2^0$ – $2^3$, will show that other waveforms as illustrated in FIGS. 6*a–p* will be produced at the output of OR gate 116 for various settings of binary thumbwheel switch 150. Adjacent each of the waveforms of FIGS. 6*a–p* are the binary numbers which when set into binary thumbwheel switch 150 will produce the accompanying waveform at the output of OR gate 116.

Figure 6:
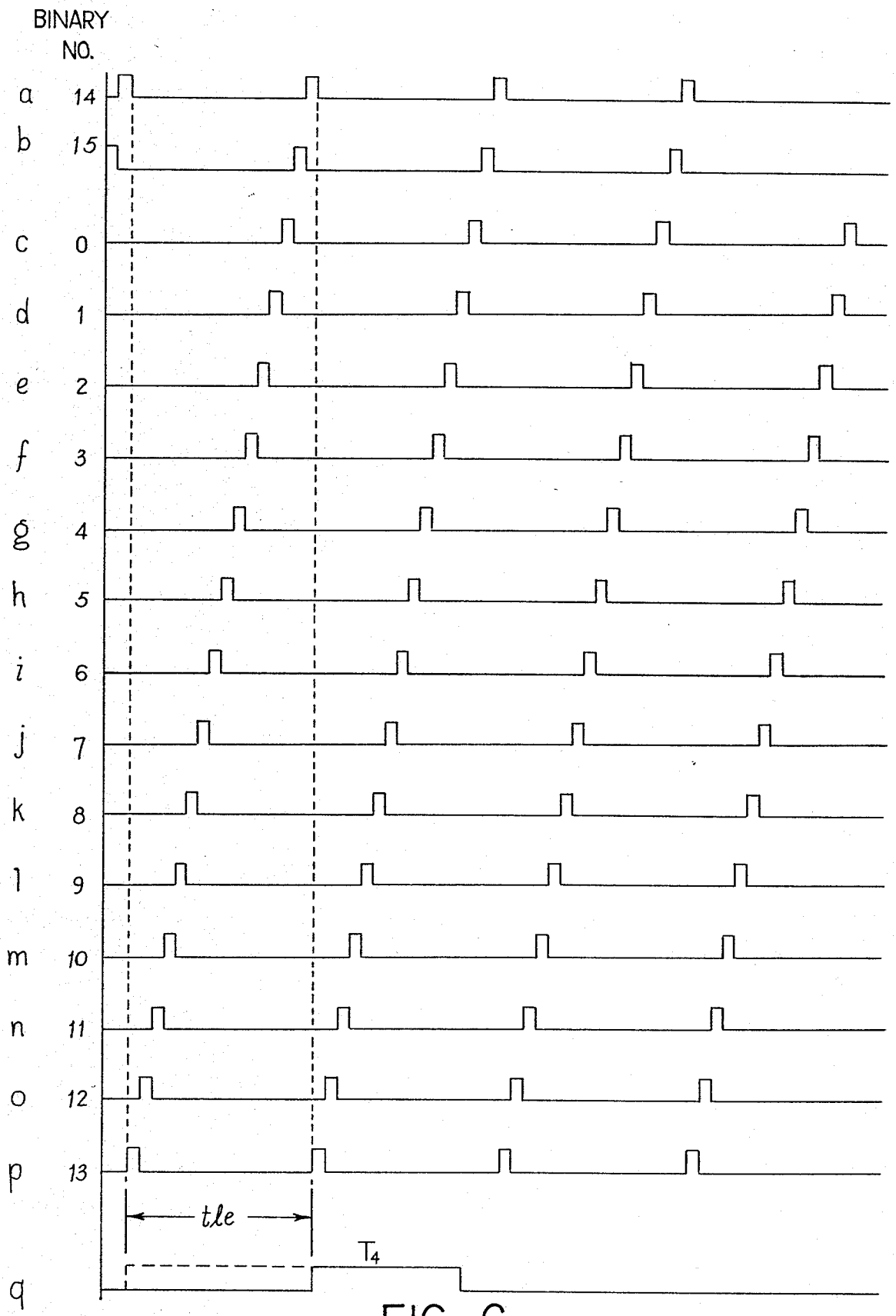

In FIG. 6 the pulses of the various waveforms that fall within the time period *tle* are the ones which determine the leading edge of waveform $T_4$ (which is reproduced as FIG. 6*q*). As may be seen, the duty cycle of waveform $T_4$ may be adjusted from its full width (width of $T_3$) to approximately half its full width. In practice, the duration of gating waveform $T_4$ may be set at approximately ¾ its full value so that a plus or minus one-quarter adjustment may be made in the gain of the red signal channel. It may be seen that the gain may be made in sixteen incremental steps by rotating binary thumbwheel switch 150. This feature provides accurate control of the calibration of an inspection channel.

In the above discussion calibration of an inspection channel was achieved by changing the gain of the red signal path. This was done by changing the duty cycle of gating waveform $T_4$ by means of thumbwheel switch 150. It is to be understood that calibration also could be changed by changing the duty cycle of gating waveform $T_3$ to change the gain of the green signal path. Furthermore, the duty cycles of both waveforms $T_3$ and $T_4$ could be changed to change the gains of both signal paths if so desired. The circuitry of FIG. 5 would be modified as required.

Just one electronic inspection channel is illustrated in FIG. 2. In practice a conveyor belt 11, FIG. 1, would have as many as eight or more parallel, aligned, or singulated, successions of produce moving along the conveyor. There would be a corresponding number of eight or more electrooptic heads for inspecting produce emanating from each singulated succession. As a consequence, there also would be eight or more electronic inspection channels each identical to FIG. 2. An advantageous feature of this invention is that only one timing generator of FIG. 4 would be utilized and the same gating signals $T_1$–$T_4$ would be coupled to all eight or more electronic inspection channels. Furthermore, just one binary thumbwheel switch 150, FIG. 4, would control the gating signal $T_4$ in all channels. This means that the adjustment of switch 150 would adjust identically the gains in red signal paths of all inspection channels. This virtually assures that all inspection channels are identically calibrated and that all eight or more parallel successions of produce on the conveyor will be identically graded.

While a preferred embodiment of the invention has been illustrated and described, it is to be understood that alterations and modifications may be made to the described embodiment without departing from the scope of the present invention.

What is claimed is:

1. In combination in an inspection signal path in which detector means produces a low level d.c. inspection signal and chopper means controlled by at least a first gating signal having a first duty cycle converts the low level d.c. signal to an a.c. signal which then is amplified in a.c. amplifier means, and wherein means including synchronous detector means reconvert the amplified a.c. signal to a d.c. signal, the improvement of gain control means for changing the gain of the inspection signal path, comprising means for producing a second gating signal having a second duty cycle which is adjustable from a maximum time period to a minimum time period, said maximum time period being no greater than said first duty cycle of said first gating signal, and means for coupling said second gating signal to said synchronous detector means for controlling its operation, whereby a change in said second duty cycle changes the magnitude of a reconverted d.c. signal thus changing the gain of said inspection signal path.

2. The combination claimed in claim 1 and further including at least a second inspection signal path that includes detector means, chopper means, a.c. amplifier means, and synchronous detector means all constructed and arranged similarly to the corresponding means in said first inspection signal path, gating signal generating means for generating said first and second gating signals and for generating a third gating signal substantially synchronous with said second gating signal, means for coupling said first gating signal from said gating signal generating means to said chopper means in each of said signal paths, means for coupling said second gating signal from the gating signal generating means to the synchronous detector means in one of said signal paths, and means for coupling said third gating signal from said gating signal generating means to the synchronous detector means in the other one of said signal paths.

3. The combination claimed in claim 2 wherein said gating signal generating means includes a duty cycle adjustment means for adjusting the duty cycle of said second gating signal, whereby adjustment of said duty cycle adjustment means changes the gains in all inspection signal channels associated with said second gating signal.

4. The combination claimed in claim 2 and further including, means responsive to the reconverted d.c. signals in said two signal paths for comparing or evaluating the two reconverted d.c. signals, whereby an adjustment in the duty cycle of the second gating signal changes the calibration of said means for comparing or evaluating said two reconverted d.c. signals.

5. In a produce grader or the like having detector means for producing at least first and second d.c. signals corresponding to respective detected characteristics of an article of produce being graded, wherein the produce grader includes first and second respective signal paths for said two d.c. signals, wherein each signal path includes chopper means for chopping the d.c. signal into an a.c. signal, a.c. amplifier means for amplifying the a.c. signal, and means including synchronous detector means for reconverting the amplified a.c. signal to a d.c. signal, and wherein the reconverted d.c. signals in the signal paths are compared and/or evaluated according to a desired calibration to form a basis for grading an article, the improvement of adjustable calibration means for simply and reliably adjusting the calibration of the grader, said improvement comprising gating signal generating means for generating at least a first gating signal for controlling said chopper means in said signal paths and for generating second and third gating signals for controlling said synchronous detector means in the respective signal paths, said gating signal generating means including means for adjusting the time duration of at least one of said second and third gating signals, whereby the magnitude of at least one of said reconverted d.c. signals may be changed as a function of the duty cycle of its respective synchronous detector gating signal, thereby to change the calibration of said produce grader.

6. The combination claimed in claim 5 wherein said produce grader includes a plurality of said detector means and a plurality of pairs of said signal paths, each pair of signal paths being associated with respective detector means and the signal paths of each pair being substantially identical to said first and second signal paths, means for coupling said first gating signal from said gating signal generating means to the chopper means in each of said plurality of paths, means for coupling said second gating signal from said gating signal generating means to the synchronous detector means in the first signal path of each pair, and means for coupling said third gating signal from said gating signal generating means to the synchronous detector means in the second signal path of each pair, whereby an adjustment in the means for adjusting the time duration of at least one of said second and third gating signals produces substantially identical adjustments of the calibrations in all pairs of signal paths.

* * * * *